US010836205B2

(12) United States Patent
Rolion et al.

(10) Patent No.: US 10,836,205 B2
(45) Date of Patent: Nov. 17, 2020

(54) MANUAL DEVICE WITH TWO RETRACTABLE HEADS CARRIED BY A SINGLE CARRIAGE

(71) Applicant: SOCIETE BIC, Clichy (FR)

(72) Inventors: Franck Rolion, Asnieres-sur-Oise (FR); Samuel Malinverni, Paris (FR); Arnaud Bez, Garches (FR)

(73) Assignee: SOCIETE BIC, Clichy (FR)

( * ) Notice: Subject to any disclaimer, the term of this patent is extended or adjusted under 35 U.S.C. 154(b) by 81 days.

(21) Appl. No.: 16/330,319

(22) PCT Filed: Sep. 6, 2017

(86) PCT No.: PCT/FR2017/052362
§ 371 (c)(1),
(2) Date: May 28, 2019

(87) PCT Pub. No.: WO2018/046847
PCT Pub. Date: Mar. 15, 2018

(65) Prior Publication Data

US 2019/0275828 A1 Sep. 12, 2019

(30) Foreign Application Priority Data

Sep. 7, 2016 (FR) ..... 16 58305

(51) Int. Cl.
*B43K 27/00* (2006.01)
*B43K 24/14* (2006.01)
(Continued)

(52) U.S. Cl.
CPC ..... *B43K 24/14* (2013.01); *A45D 40/205* (2013.01); *A45D 40/24* (2013.01); *B25G 1/08* (2013.01);
(Continued)

(58) Field of Classification Search
CPC .... B43K 24/14; B43K 24/143; B43K 24/146; B43K 24/03; B43K 24/06; B43K 24/08;
(Continued)

(56) References Cited

U.S. PATENT DOCUMENTS 4,560,297 A 12/1985 Leem
6,412,998 B1 * 7/2002 Ham ..... B43K 27/08 401/17
2019/0322121 A1 * 10/2019 Mazingue ..... B43K 24/166

FOREIGN PATENT DOCUMENTS

EP 2143567 1/2010
FR 1319055 2/1963
(Continued)

OTHER PUBLICATIONS

International Search Report dated Nov. 17, 2017 in corresponding PCT International Patent Application No. PCT/FR2017/052362, 6 pages.

*Primary Examiner* — Jennifer C Chiang
(74) *Attorney, Agent, or Firm* — Ohlandt, Greeley, Ruggiero & Perle, L.L.P.

(57) ABSTRACT

A manual device extends in an axial direction and includes a housing having a first housing portion and a second housing portion. First and second heads are each axially movable between a use position and a stowed position. The first head is in the stowed position when the second head is in the use position, whereas the second head is in the stowed position when the first head is in the use position. The first head and the second head both are carried by a single carriage movable in the axial direction and arranged inside a barrel. A groove forming a cam track is formed by a first shoulder of the first housing portion and by a second shoulder of the barrel. A lug of the carriage cooperates with the groove.

8 Claims, 4 Drawing Sheets

(51) Int. Cl.

| | |
|---|---|
| ***A45D 40/20*** | (2006.01) |
| ***A45D 40/24*** | (2006.01) |
| ***B25G 1/08*** | (2006.01) |
| ***B43K 23/06*** | (2006.01) |
| ***B43K 27/02*** | (2006.01) |
| ***B43K 27/08*** | (2006.01) |
| ***B43K 29/18*** | (2006.01) |
| ***B43K 29/00*** | (2006.01) |
| ***B43M 11/06*** | (2006.01) |
| *B43L 19/00* | (2006.01) |

(52) U.S. Cl.
CPC ..... *B43K 23/06* (2013.01); *B43K 24/143* (2013.01); *B43K 24/146* (2013.01); *B43K 27/00* (2013.01); *B43K 27/02* (2013.01); *B43K 27/08* (2013.01); *B43K 29/00* (2013.01); *B43K 29/18* (2013.01); *B43M 11/06* (2013.01); *A45D 2040/208* (2013.01); *B43L 19/0068* (2013.01)

(58) Field of Classification Search
CPC ..... B43K 27/02; B43K 27/08; B43K 27/12; B43K 23/06; B43K 29/18; A45D 40/205; A45D 40/24; B25G 1/08; B43M 11/06
See application file for complete search history.

(56) References Cited

FOREIGN PATENT DOCUMENTS

| | | |
|---|---|---|
| GB | 2487526 | 8/2012 |
| JP | 2008-307803 | 12/2008 |

* cited by examiner

MANUAL DEVICE WITH TWO RETRACTABLE HEADS CARRIED BY A SINGLE CARRIAGE

FIELD OF THE INVENTION

The invention relates to a longitudinal manual device comprising two heads, each being mounted retractable relative to one end of the manual device. Notably, the invention relates to writing instruments, but not exclusively.

PRIOR ART

Known manual devices with two retractable heads are generally not completely satisfactory from the viewpoints of ergonomics, comfort of use, bulk and reliability, all while facilitating manufacture and assembly. There is therefore a need in this sense.

SUMMARY OF THE INVENTION

One embodiment relates to a manual device extending in an axial direction, comprising a housing having a first housing part having a first distal end and a second housing part having a second distal end opposite the first distal end in the axial direction, a first head axially mobile between a use position in which the first head projects from the housing from the first distal end and a retracted position in which the first head is retracted into the housing, and a second head axially mobile between a use position in which the second head projects from the housing from the second distal end and a retracted position in which the second head is retracted into the housing, the first head being in the retracted position when the second head is in the use position, while the second the head is in the retracted position when the first head is in the use position, a barrel being disposed inside the housing, the first head and the second head both being borne by a single carriage mobile in the axial direction, the carriage being disposed at least partly within the barrel, the first housing part being rotatably coupled with the barrel around the axial direction, while the second housing part is rotatably coupled with the carriage around the axial direction, the carriage being rotatably mobile around the axial direction relative to the first housing part and relative to the barrel, wherein a groove forming a cam path is formed by a first shoulder of the first housing part and by a second shoulder of the barrel, while the carriage has a lug cooperating with the groove.

It is understood that the heads are disposed opposite one another in the axial direction within the manual device. It is also understood that by moving the carriage in the axial direction, the first head and the second head are moved into and out of the housing. Since the heads are borne by the same carriage, the axial movement of the chariot to move one head axially also moves the other head in the same direction. Obviously, according to one variant, an intermediate position of the carriage is a position where both heads are in the retracted position. It is therefore understood that both heads cannot be simultaneously in the use position.

Of course, the housing can be formed from a single piece, or from several pieces. The housing therefore forms the outer part of the manual device. For example, in the case of a writing instrument, for example a pen, the housing is formed by the outer barrel of the pen.

It is understood that the heads may be formed by any tool tip of the manual device, for example a wrench, a screwdriver, a blade, a punch, a writing unit (felt tip, ball or other, graphite lead, chalk, or any means that permits writing on a substrate), a brush, an eraser, a friction unit, a pad or stylus for a capacitive screen, a cosmetic applicator (brush, pencil, mascara brush, ball applicator, lipstick or any means for application of cosmetics), etc.

It is also understood that the assembly formed by the first part of the housing and the barrel is mobile in rotation around the axial direction relative to the assembly formed by the second part of the housing and the carriage. Thus, via the cam path and the lug, by pivoting the first housing part relative to the second housing part around the axial direction, the carriage is moved in the axial direction. Thus, it is understood that during its axial movement, the carriage slides within the barrel. Of course, the sliding can follow a purely axial movement or even a helical movement.

Due to the single carriage, and the shoulders forming the walls of the cam path groove, the manual device has a reduced number of elements, which gives it a relatively simple structure and therefore makes it reliable and easy to assemble. This also permits having a single, particularly compact, mechanism for axial movement of the carriage, by means of which the manual device may have dimensions adaptable to the hands of the majority of users.

Moreover, the shoulders forming the walls of the groove forming the cam path are particularly easy to manufacture by molding while avoiding any complexity of the undercut type. Thanks to this configuration, the shoulders may be essentially perpendicular to the axial direction (i.e. 90°±5°). It is thus ensured that the carriage lug cooperates with the cam path via a surface contact and non-linear contact generatrix. This considerably improves the kinematics of the mechanism for axial movement of the carriage by having high precision with no risk of jamming.

Moreover, the movement of the heads by a single carriage allows combining the movement of the heads in the axial direction and in opposite directions, which also permits reducing the overall bulk while further providing a certain ergonomics and ease of use. Finally, the fact that both heads cannot be simultaneously in the use position provides a certain degree of comfort or safety for the user who is thus assured that he will not hit one head that is not to be used when using the other head, and thereby said head is prevented from being damaged, and/or, for example, the user is prevented from being injured in the case of a blade, or from being written on in the case of a writing instrument, etc.

In certain embodiments, the manual device comprises a first compression spring between the first part of the housing and the carriage and a second compression spring between the second part of the housing and the carriage.

Such springs assist with the axial movement of the carriage. Thus, on the one hand, the perceived quality of the axial movement mechanism of the carriage is improved.

In certain embodiments, the first housing part and the second housing part are locked axially relative to the barrel.

For example, the first housing part and the second housing part are mounted by snapping onto the barrel, the first part being coupled in translation and in rotation with the barrel, while the second part of the housing is coupled only in translation with the barrel and remains mobile in rotation around the axial direction relative to the barrel. Such locking provides a reduced bulk, a simple structure and thus a certain reliability and ease of assembly for the manual device.

It is noted that snapping (or clipping) is a method of assembling two parts by engagement and elastic deformation (generally local deformation of only one portion of a part, for example a tongue, or a peripheral element of said portion, or by deformation of all the portions involved in the assembly). When the two parts are engaged in the snapped-in position, the parts generally return to their initial form and no longer exhibit elastic deformation (or exhibit less elastic deformation). When the two parts are engaged with one another in the snapped-in position, they cooperate with one another so as to oppose, or even block, the relative movements of said parts in the release direction (the direction opposite to the engagement direction). In the snapped-in position, the two parts may also cooperate so as to oppose, or even block, their relative movements in the direction of extension of the engagement, beyond the snapped-in position. Assembly by snapping has the advantage of being easy to implement and reliable.

In some embodiments, the second housing part is mounted on the barrel by means of a snap ring.

For example, the snap ring is mobile in rotation around the barrel but locked in translation on the barrel, while the second part of the housing is snapped into the ring and locked in translation and in rotation with the ring. Such an assembly structure is simple and particularly reliable.

For example, the mounting of the second part of the housing on the barrel by way of the snap ring is a self-locking mounting, preventing the second housing part from being disengaged from the barrel. For example, when the ring is mounted on the barrel, it is radially deformed toward the outside and locks the assembly with the second part of the housing. Of course, "preventing any disengagement" means "preventing any disengagement without completely or partially damaging any component of the assembly."

In certain embodiments, the second part of the housing has a radial projection cooperating with an annular surface of the barrel along a predetermined circumferential path, the annular surface of the barrel having at least one relief centered relative to the middle of the circumferential path. Of course, a radial direction is a direction perpendicular to the axial direction.

It is understood that the circumferential path corresponds to the circumferential length traveled by the projection along the annular surface during the relative rotation of the second housing part with regard to the barrel in order to bring the carriage from one extreme axial position to the other, i.e., to go from the position of use of the first head to the position of use of the second head, or vice versa. The relief is centered relative to the middle of this path. For example, there is a single relief disposed in the middle of the path. According to another example, there are two reliefs disposed on either side of the middle of the path, equidistant from the middle along the path. According to still another example, there are three reliefs, one relief disposed in the middle, and two other reliefs disposed on either side and equidistant from said centered relief.

The relief is configured to cooperate by friction with the projection so as to generate, when the second housing part is rotated, a hard point in the middle of the circumferential path. "Hard point" means a position where the rotation of the second housing part requires more effort on the part of the user than for rotation in the other positions of the path. This middle of the path corresponds to the intermediate position of the carriage where both heads are retracted. In particular, such a hard point permits holding the second housing part in position relative to the barrel, and therefore preventing the head from accidentally going into the use position, thanks to which reliability and comfort of use are improved. Furthermore, this hard point forms a reference for the user, by means of which the perceived quality of the manual device is improved. Moreover, this prevents the user from needlessly forcing the carriage advance mechanism, thanks to which the reliability of the assembly is increased.

In certain embodiments, the cam path has successively a first helical portion having a first pitch, an intermediate portion having a second pitch less than the first pitch or a zero pitch, and a second helical portion having a third pitch equal to the first pitch.

It is understood that the first helical portion corresponds to the portion for moving the first head in and out of the first distal end (the second head being retracted), the second portion corresponds to the portion for moving the second head in and out (the first head being retracted), while the intermediate portion corresponds to a transitional portion where neither the first head nor the second head is in use position (i.e., both heads are in retracted position).

Such a cam path is particularly comfortable to use and makes handling the manual device particularly intuitive and ergonomic. Indeed, during use, the user clearly has a "status" indication of the movement of the carriage, i.e., if it is in the intermediate position, or if it is in the process of moving a head in or out. For example, such a configuration of the cam path combined with the hard point in the middle of the rotation path of the second housing part provides a particularly agreeable comfort of use. This also prevents the user from needlessly forcing the carriage advance mechanism, thanks to which the reliability of the assembly is increased.

In certain embodiments, at least one head among the first and the second head is a writing component.

The structure of the manual device is particularly suited for writing instruments comprising, for example, a writing unit on one side, and, on the other side, another writing unit, an eraser, a friction unit, or a stylus for a touchscreen. It is understood that the stylus ("pad" in English) is a tip configured to interact with a capacitive screen. The stylus is conductive (due to its manufacturing material or due to a coating). The shape, flexibility/rigidity and the material(s) of a stylus are not limited as long as the stylus can interact with a capacitive screen, i.e., its contact with a capacitive screen is detectable by this screen.

In certain embodiments, the at least one writing component is removable.

It is therefore understood that the writing unit(s) may be replaced. Thus, the manual device forms a reloadable writing instrument. For example, the first and/or second housing part(s) can be disassembled or are formed of several parts that can be disassembled, by means of which the removable writing unit can be easily replaced.

BRIEF DESCRIPTION OF THE DRAWINGS

The invention and its advantages will be better understood upon reading the detailed description below of different embodiments of the invention given by way of non-limiting examples. This description refers to the appended figure pages, in which.

DETAILED DESCRIPTION OF EXAMPLES OF EMBODIMENT

Figure 1:
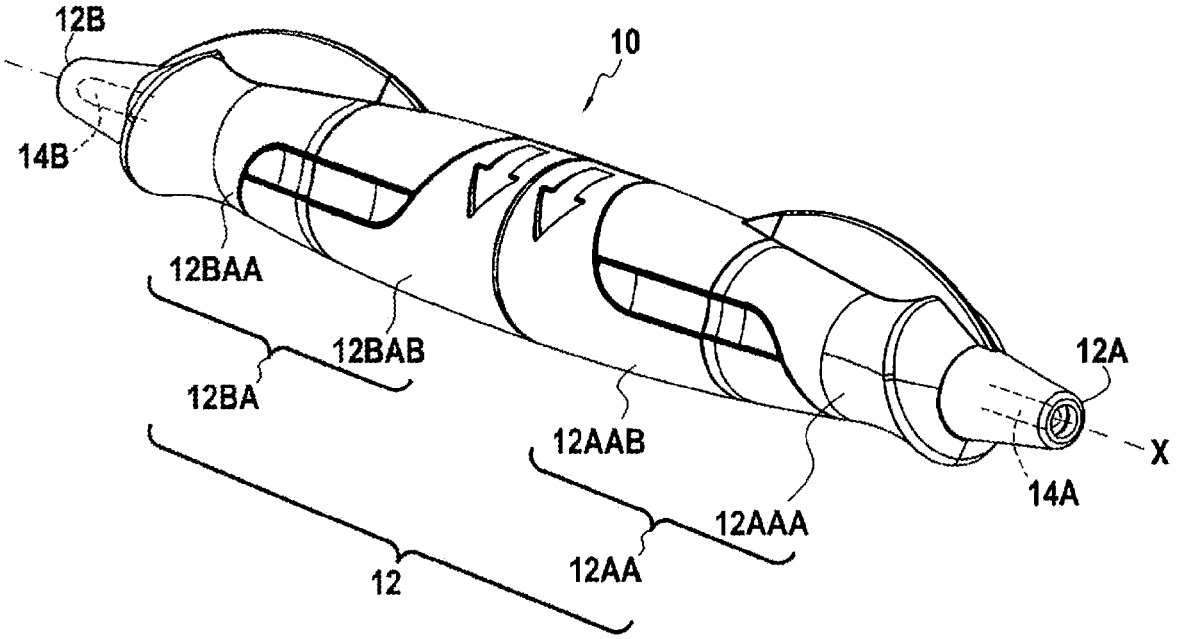
FIG. 1 shows a manual device in perspective.

FIG. 1 shows a manual device 10, in this example a writing instrument 10, comprising a housing 12 having a first distal end 12A with a first orifice for the passage of a head and a second distal end 12B opposite first distal end 12A in the axial direction X, with a second orifice for the passage of another head. Manual device 10 comprises a first head 14A axially mobile between a retracted position in which it is retracted in barrel 12 and a use position in which it projects from barrel 12 from first distal end 12A. A second head 14B is axially mobile between a retracted position in which it is retracted in barrel 12 and a use position in which it projects from barrel 12 from second distal end 12B. Although in FIG. 1 the first and second heads 14A and 14B are in retracted position, they are nevertheless shown schematically by dotted lines for clarity of this disclosure. Housing 12 comprises a first housing part 12AA with first end 12A and a second housing part 12BA with second end 12B.

Figure 2A:
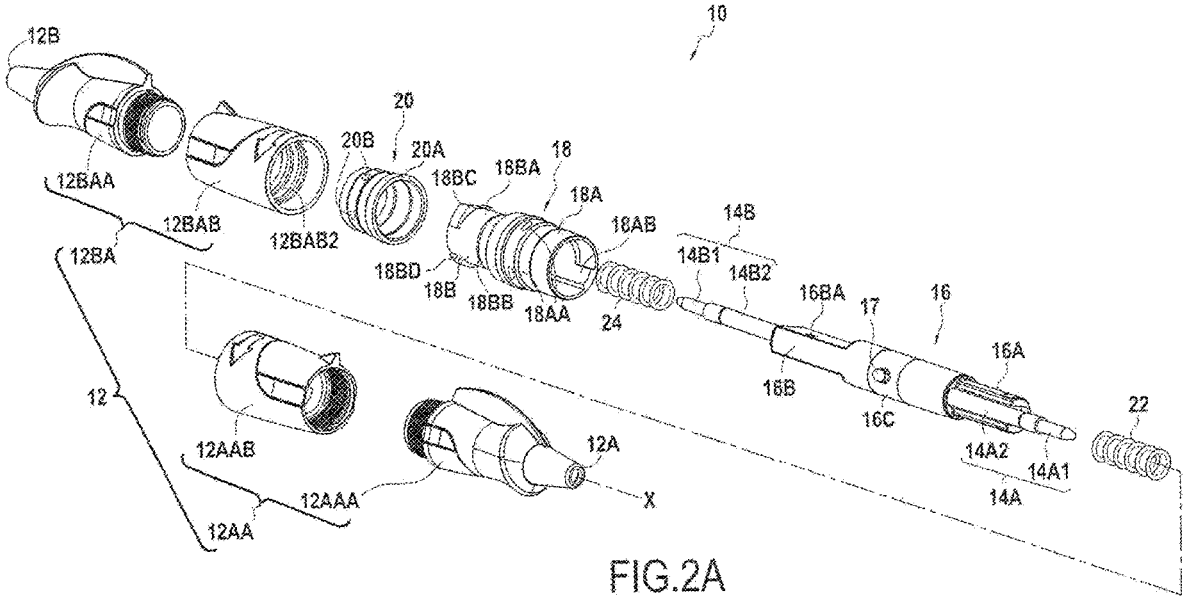
FIGS. 2A and 2B show the manual device in perspective and exploded along two different viewpoints.
Figure 2B:
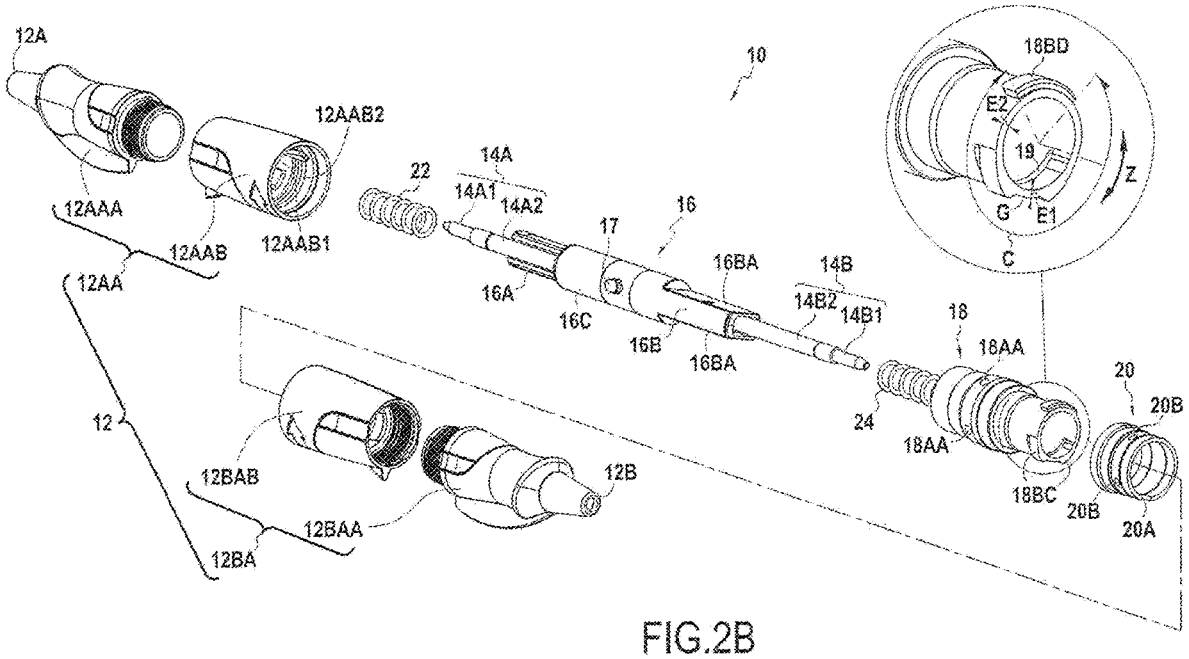

More particularly, in reference to FIGS. 2A and 2B, each housing part 12AA and 12BA comprises two portions assembled by screwing together. Thus, the first part 12AA has a first portion 12AAA with first end 12A and a second portion 12AAB. Second part 12BA has a first portion 12BAA with second end 12B and a second portion 12BAB. First portions 12AAA and 12BAA of first and second housing parts 12AA and 12BA form distal end portions of housing 12, while second portions 12AAB and 12BAB of first and housing parts 12AA and 12BA form intermediate portions of housing 12.

In reference to FIG. 2B, first housing part 12AA, and, more precisely in this example, second portion 12AAB, has a groove 12AAB1 extending axially to rotatably couple first part 12AA in rotation around the axial direction X with barrel 18 described below. Furthermore, first part 12AA, and more precisely in this example, second portion 12AAB, has an annular snap relief 12AAB2, in this example an annular rib, to assemble first housing part 12AA by snapping together with barrel 18.

Figure 4:
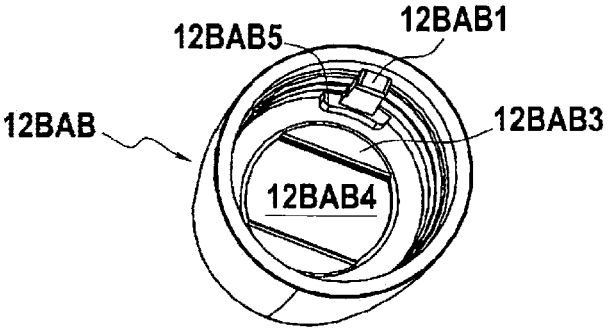
FIG. 4 shows the second portion of the second housing part, seen along arrow IV of FIG. 2A.

In reference to FIGS. 2A and 4, second housing part 12AB, and, more precisely in this example, second portion 12BAB, has a groove 12BAB1 extending axially to rotatably couple second part 12BA in rotation around the axial direction X of second part 12BA with ring 20 described below. Furthermore, second part 12BA, and more precisely in this example, second portion 12BAB has an annular snap relief 12BAB2, in this example an annular rib, for assembling the second housing part 12BA by snapping into ring 20. Moreover, second housing part 12BA, and more particularly in this example second portion 12BAB, has an inner radial crosspiece 12BAB3 defining an essentially rectangular window 12BAB4. Since a radial direction is a direction perpendicular to the axial direction X, it is understood that crosspiece 12BAB3 extends perpendicularly to the axial direction X. Furthermore, a radial projection 12BAB5 is disposed in the axial extension of rib 12BAB1, the extent in the circumferential direction of this projection 12BAB5 being greater than the circumferential extent of rib 12BAB1. The median axial planes respectively of rib 12BAB1 and projection 12BAB5 are merged.

As can be seen in FIGS. 2A and 2B, housing 12 houses a single carriage 16 bearing first and second heads 14A and 14B, a barrel 18 equipped with a snap ring 20, as well as two compression springs 22 and 24.

First and second heads 14A and 14B are writing units in this example, and, more particularly, ballpoints 14A1, 14B1 respectively mounted on an ink reservoir 14A2, 14B2. Furthermore, since first portions 12AAA and 12BAA of housing parts 12AA and 12BA are respectively assembled by screwing with second portions 12AAB and 12BAB, these first portions 12AAA and 12BAA may be easily disassembled, by means of which writing units 14A and 14B can be removed.

Carriage 16 extends along the axial direction X and has a first portion 16A forming a first casing receiving first head 14A, and more particularly ink reservoir 14A2 of first head 14A, a second portion 16B forming a second casing receiving second head 14B, and more particularly ink reservoir 14B2 of second head 14B, and an intermediate portion 16C disposed between first portion 16A and second portion 16B. It is noted that ink reservoirs 14A2, 14B2 are respectively engaged with radial play in first and second portions 16A and 16B so as not to restrain reservoirs 14A2, 14B2 in the radial direction, by means of which first and second heads 14A and 14B can be easily moved in the radial direction so as to be guided by the inner walls of housing 12 and align with the orifices of first and second distal ends 12A and 12B in order to be able to move into the use position.

Carriage 16 also has a lug 17 projecting radially. The outer surface of second portion 16B of carriage 16 has two flattened areas 16BA extending parallelly to the axial direction X. Second portion 16B is engaged in window 12BAB4, flattened areas 16BA cooperating by shape complementarity with the edges of window 12BAB4 (i. e. with crosspiece 12BAB3), by means of which second housing part 12BA is coupled with carriage 16 in rotation around the axial direction X.

Barrel 18 extends along the axial direction X and has the shape of a hollow cylindrical sleeve. Barrel 18 receives carriage 16 by sliding along the axial direction X. As will be described later, in this example, the sliding is a helical sliding, i.e., having a translation movement along the axial direction X and a rotation movement around the axial direction X.

Barrel 18 has a first portion 18A fitted in first housing part 12AA, and more particularly in this example in second portion 12AAB of first housing part 12AA. This first portion 18A has on its external surface a plurality of snap reliefs 18AA, in this example elliptical shaped protrusions, in order to snap barrel 18 together with first housing part 12AA. More precisely in this example, reliefs 18AA cooperate by snapping together with annular reliefs 12AAB2 of second portion 12AAB of first housing part 12AA. Furthermore, first portion 18A is provided with an inner rib 18AB (see FIG. 2A) in order to couple barrel 18 in rotation around the axial direction X with first housing part 12AA, rib 18AB of barrel 18 being engaged in groove 12AAB1 (see FIG. 2B) of first housing part 12AA.

Barrel 18 has a second portion 18B, adjacent to first portion 18B*, fitted in second housing part 12BA, and more particularly in this example in second portion 12BAB of second housing part 12BA. Second portion 18B has an annular surface 18BA forming a bearing that receives, by rotating around the axial direction X, snap ring 20 described below. Furthermore, a shoulder 18BA, on one hand, and reliefs 18BC as well as stop 18BD, on the other hand, lock ring 20 in axial translation.

* sic; first portion 18A?—Translator's note

Ring 20 is annular in shape and has a slot 20A extending axially along the entire axial length of the ring 20. This slot gives ring 20 a certain elasticity, by means of which it can be fitted around annular surface 18BA of barrel 18. Furthermore, ring 20 has on its external surface a plurality of snap reliefs 20B, in this example elliptical-shaped protrusions, in order to assemble ring 20 with second housing part 12BA. More precisely in this example, reliefs 20B cooperate by snapping together with annular reliefs 12BAB2 of second portion 12BAB of second housing part 12BA.

Thus, second housing part 12BA is mounted on barrel 18 by means of ring 20. Rib 12BAB1 of second housing part 12BA is engaged in slot 20A of ring 20, by means of which second housing part 12BA and ring 20 are coupled in rotation around the axial direction X. Since second housing part 12BA is mounted by snapping onto ring 20, it is thereby locked in translation along the axial direction X with respect to ring 20. Thus, since second housing part 12BA is coupled with ring 20, it has the same degrees of freedom as ring 20 with respect to barrel 18. Consequently, second barrel part 12BA is locked in translation along the axial direction X with respect to barrel 18, while it is mobile in rotation around the axial direction X relative to barrel 18.

Stop 18BD of barrel 18 cooperates by abutting in the circumferential direction Z the radial projection 12BAB5 of second housing part 12BA. Thus, this stop 18BD defines a rotational circumferential path C of first housing part 12BA* around the axial direction X relative to barrel 18. Furthermore, it is noted that reliefs 18BC are disposed on either side along circumferential direction Z of the middle of circumferential path C, equidistant from the middle. These reliefs 18BC form two opposite ramps along the circumferential direction Z. A through cut 19 extends circumferentially along reliefs 18BC. Furthermore, thickness E1 of the wall of the portion of barrel 18 bearing reliefs 18BC is smaller than thickness E2 of the barrel along path C. Through cut 19 and thickness E1 provide a certain elasticity permitting a local deformation of the portion of barrel 18 bearing reliefs 18BC, by means of which projection 12BAB5 can pass over reliefs BC by running along path C. It is noted that the circumferential length of space G separating reliefs 18BC is essentially equal (i.e., equal to or a maximum of 10% greater than) the circumferential extent of projection 12BAB5. These reliefs 18BC thus form a hard point when passing projection 12BAB5 indicating a median position to the user. Thus, radial projection 12BAB5 cooperates with the annular surface extending between the two circumferential ends of stop 18BD along circumferential path C.

* sic; second housing part BA?—Translator's note.

Figure 3:
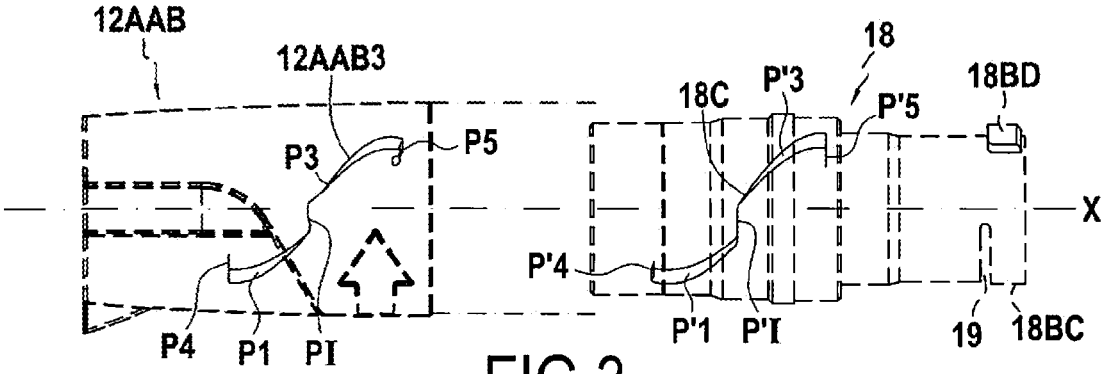
FIG. 3 shows the shoulders forming the cam path arranged in the second housing part and in the inner barrel.

FIG. 3 is an exploded view transparently showing only second portion 12AAB of first housing part 12AB and barrel 18. Thus, one can see a shoulder 12AAB3 (or first shoulder) of second portion 12AAB and a shoulder 18C (or second shoulder) of barrel 18. Of course, these shoulders form bearing surfaces perpendicular to the axial direction X and are oriented facing one another. Thus, when first housing part 12AA is assembled with barrel 18, a groove forming a cam path is formed between shoulder 12AAB3 and shoulder 18C. Of course, when these two elements are assembled, carriage 16 is intercalated so that lug 17 is housed in the groove, between shoulders 12AAB3 and 18C. Consequently, lug 17 of carriage 16 is guided by the cam path. Carriage 16 is thus mobile in rotation around the axial direction X relative to a first housing part 12AA and to barrel 18, this rotation moving carriage 16 in translation along the axial direction X by means of the cam path.

It is noted that each shoulder 12AAB3 and 18C, and, consequently, the cam path, have, successively, a first helical portion P1, P'1 having a first pitch, an intermediate portion PI, P'I having a second zero pitch, and a second helical portion P3, P'3 having a third pitch equal to the first pitch. Furthermore, final portions P4, P'4 and P5, P'5 form extensions of the cam path receiving lug 17 to prevent the user from exerting unnecessary stress on the latter at the end of the course of the cam path during the passage of first head 14A, and respectively of second head 14B, from the retracted position to the use position.

A first spring 22 is disposed in first housing part 12AA and cooperates in support, on the one hand, with the second housing part 12AA*, and more specifically in this example with first portion 12AAA of first housing part 12AA, and, on the other hand, with carriage 16, and more particularly in this example with the free end of first portion 16A of carriage 16.

* sic; second housing part 12BA?—Translator's note.

A second spring 24 is disposed in second housing part 12BA and cooperates in support, on the one hand, with second housing part 12BA, and more specifically in this example with first portion 12BAA of second housing part 12BA, and, on the other hand, with carriage 16, and more particularly in this example with the free end of second portion 16B of carriage 16.

We will now describe the order of assembly of the various elements. First, carriage 16 is disposed axially between barrel 18 and first housing part 12AA so that lug 17 is disposed between the two shoulders 12AAB3 and 18, and then barrel 18 is assembled with first housing part 12AA thus forming a groove forming a cam path in which lug 17 is disposed. Ring 20 can be mounted on barrel 18 before or after this first operation. Next, second housing part 12BA is assembled with barrel 18 by means of ring 20. It is noted that during the preceding operations, either first portions 12AAA and 12BAA are assembled with second portions 12AAB and 12BAB, in which case heads 14A and 14B are preassembled with carriage 16 before the assembly described above and during which springs 22 and 24 are intercalated, or first portions 12AAA and 12BAA are not assembled with second portions 12AAB and 12BAB, in which case heads 14A and 14B provided with springs 22 and 24 are subsequently assembled with carriage 16 before assembling first portions 12AAA and 12BAA to second portions 12AAB and 12**BAB.

** sic; shoulder 18C?—Translator's note.

Figure 5A:
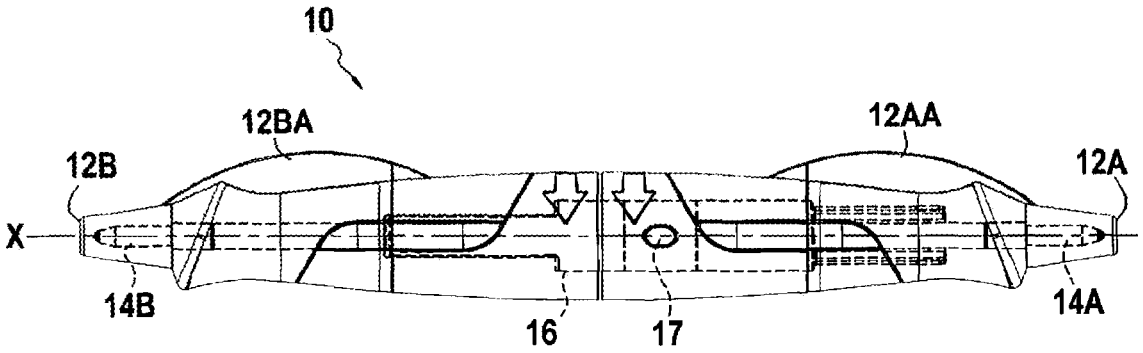
FIGS. 5A, 5B and 5C show different configurations of the manual device of FIG. 1.
Figure 5B:
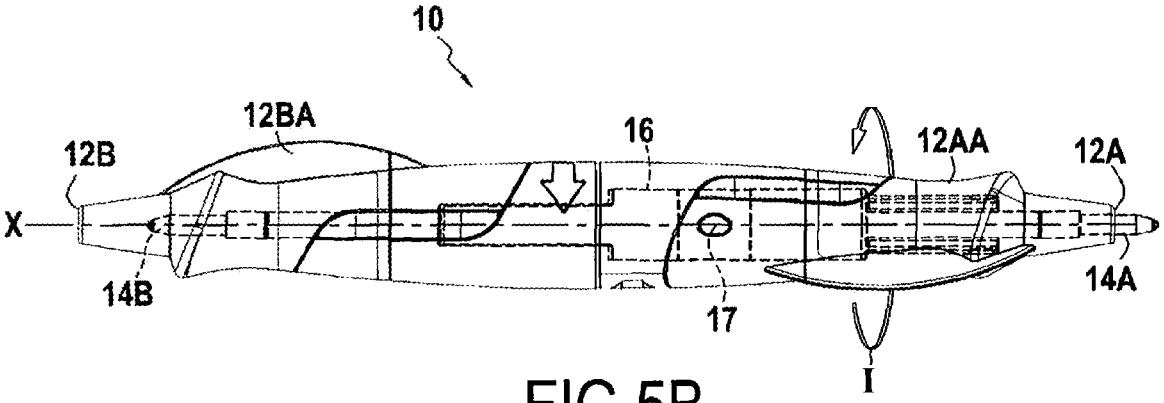
Figure 5C:
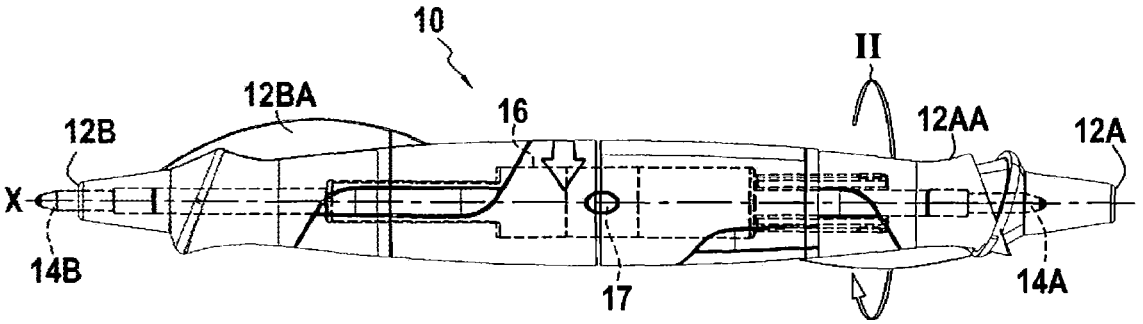

We will now describe the kinematics of the various elements of manual device 10 when heads 14A and 14B go from the retracted position to the use position, with reference to FIGS. 5A to 5C. For clarity and readability, only carriage 16 and the heads are shown in FIGS. 5A to 5C in housing 12.

FIG. 5A corresponds to the position shown in FIG. 1, where both heads 14A and 14B are in the retracted position. Carriage 16 is in the intermediate position, lug 17 being in portion PI, P'I of the cam path. Furthermore, radial projection 12BAB5 of second housing part 12BA is disposed in space G between the two reliefs 18BC of barrel 18.

In FIG. 5B, first housing part 12AA is turned around the direction X relative to second housing part 12BA, according to arrow I. Since carriage 16 is coupled in rotation with second housing part 12BA, it remains in the same angular position as second housing part 12BA. Since first housing part 12AA is coupled in rotation with barrel 18, these two elements turn together. Thus, during rotation of first housing part 12AA, the cam path turns relative to carriage 16, by means of which lug 17 is entrained along the cam path and moves axially. During the rotational movement indicated in FIG. 1, lug 17 travels along helical portion P1, P'1 and arrives in the final portion P4, P'4. Thus, carriage 16 is moved axially, entraining first and second heads 14A and 14B, first head 14A going from the retracted position to the use position. It is noted that second head 14B is also moved axially but remains retracted in housing 12. During the rotational movement of first housing part 12AA relative to second housing part 12BA, radial projection 12BAB5 of second housing part 12BA crosses over a relief 18BC and travels along path C to abut against stop 18BD of barrel 18.

In order to move first head 14A from the use position shown in FIG. 5B to the retracted position shown in FIG. 5A, an opposite movement is conducted, i.e., first housing part 12AA is turned relative to second housing part 12BA in a direction opposite to arrow I.

FIG. 5C corresponds to a movement opposite to the one described with reference to FIG. 5B, first housing part 12AA being turned around direction X relative to second housing part 12BA according to arrow II, which is opposite to arrow I of FIG. 5B. Thus, the movements are strictly similar to those described above with reference to FIG. 5B, except that lug 17 travels in helical portion P3, P'3 to arrive in final portion P5, P'5 of the cam path. Thus, since, during this movement, the initial configuration is the one shown in FIG. 5A, second head 14B goes from the retracted position to the use position while first head 14A is moved in housing 12 while remaining retracted.

Of course, to return manual device 10 from the configuration shown in FIG. 5C to the configuration shown in FIG. 5A, the opposite movement is conducted, i.e., first housing part 12AA is turned relative to second housing part 12BA in the direction opposite to arrow II.

Although the present invention has been described by referring to specific exemplary embodiments, it is obvious that modifications and changes can be made to these examples without departing from the general scope of the invention as defined by the claims. In particular, individual characteristics of the different embodiments illustrated/discussed may be combined into additional embodiments. Consequently, the description and drawings must be considered in an illustrative rather than a restrictive sense.

The invention claimed is:

1. A manual device extending in an axial direction comprising: a housing having a first housing part having a first distal end and a second housing part having a second distal end opposite the first distal end in the axial direction; a first head being axially mobile between a use position in which the first head projects from the housing from the first distal end and a retracted position in which the first head is retracted into housing; a second head axially mobile between a use position in which the second head projects from the housing from the second distal end and a retracted position in which the second head is retracted into housing, the first head being in the retracted position when the second head is in the use position while the second head is in the retracted position when the first head is in the use position; and a barrel being disposed inside the housing, the first head and the second head both being borne by a carriage that is a single carriage mobile along the axial direction, the carriage being arranged at least partly inside barrel, the first housing part being coupled with the barrel in rotation around the axial direction, while the second housing part is coupled with the carriage in rotation around the axial direction, the carriage being rotatable around the axial direction relative to the first housing part and relative to the barrel, a groove forming a cam path being formed by a first shoulder of the first housing part and by a second shoulder of the barrel while the carriage has a lug cooperating with the groove.

2. The manual device according to claim 1, further comprising a first compression spring between the first housing part and the carriage and a second compression spring between the second housing part and the carriage.

3. The manual device according to claim 1, wherein the first housing part and the second housing part are locked axially relative to the barrel.

4. The manual device according to claim 3, wherein the second housing part is mounted on the barrel by a snap ring.

5. The manual device according to claim 1, wherein the second housing part has a radial projection cooperating with an annular surface of the barrel along a predetermined circumferential path, and wherein the annular surface of the barrel has at least one relief centered relative to the middle of the circumferential path.

6. The manual device according to claim 1, wherein the cam path has successively a first helical portion having a first pitch, an intermediate portion having a second pitch less than the first pitch or a zero pitch, and a second helical portion having a third pitch equal to the first pitch.

7. The manual device according to claim 1, wherein at least one head of the first head and the second head is a writing unit.

8. The manual device according to claim 7, wherein the at least one writing unit is removable.

* * * * *